US010533789B2

(12) United States Patent
Allen

(10) Patent No.: US 10,533,789 B2
(45) Date of Patent: Jan. 14, 2020

(54) COMPACT BEVERAGE COOLING APPARATUS

(71) Applicant: Allen Enterprises, LLC, Denver, CO (US)

(72) Inventor: Scott Allen, Denver, CO (US)

(73) Assignee: Allen Enterprises, LLC., Denver, CO (US)

( * ) Notice: Subject to any disclaimer, the term of this patent is extended or adjusted under 35 U.S.C. 154(b) by 399 days.

(21) Appl. No.: 15/090,205

(22) Filed: Apr. 4, 2016

(65) Prior Publication Data

US 2016/0290703 A1 Oct. 6, 2016

Related U.S. Application Data

(60) Provisional application No. 62/142,153, filed on Apr. 2, 2015.

(51) Int. Cl.
*F25D 3/08* (2006.01)
*A45C 11/20* (2006.01)

(52) U.S. Cl.
CPC ..... *F25D 3/08* (2013.01); *A45C 11/20* (2013.01)

(58) Field of Classification Search
CPC .... F25D 31/006; F25D 31/007; F25D 31/008; F25D 2303/08; F25D 2303/08222; F25D 2303/0841; F25D 2303/0842; F25D 2303/0843; F25D 2303/0844; F25D 2331/803; F25D 2303/0832; F25D 2331/801; A45C 11/20
See application file for complete search history.

(56) References Cited

U.S. PATENT DOCUMENTS

| | | | | |
|---|---|---|---|---|
| 3,263,806 | A | 8/1966 | Ring | |
| 4,754,879 | A | 7/1988 | Benno | |
| 4,819,793 | A * | 4/1989 | Willard | A45C 3/04 206/162 |
| 4,862,674 | A * | 9/1989 | Lejondahl | B65D 81/386 53/432 |
| 5,095,718 | A | 3/1992 | Ormond et al. | |
| 5,857,570 | A | 1/1999 | Brown | |
| 8,991,600 | B1 | 3/2015 | Normand | |
| 9,618,252 | B2 * | 4/2017 | Andrews | F25D 3/08 |
| 2007/0084236 | A1 * | 4/2007 | Panganiban | F25D 3/08 62/457.3 |
| 2011/0215016 | A1 | 9/2011 | Block | |
| 2011/0239677 | A1 * | 10/2011 | Roekens | A47F 3/043 62/252 |
| 2017/0138664 | A1 * | 5/2017 | Greenberg | F25D 3/08 |

* cited by examiner

*Primary Examiner* — Henry T Crenshaw
*Assistant Examiner* — Kamran Tavakoldavani
(74) *Attorney, Agent, or Firm* — VOZ Patents, LLC.

(57) ABSTRACT

The present invention as disclosed herein surrounds a cooling apparatus configured to provide an enclosed envelope and cooling-pack for a reduced form-factor. Embodiments of the present invention provide a cooling apparatus for the transportation of beverage containers in a manner that keeps them colder for longer periods than transport within a non-insulated transportation device. The efficient and compact cooling of beverage containers as provided by the present invention in certain embodiments allows the user to transport the cooling apparatus within a backpack, handbag or other secondary transportation device.

19 Claims, 11 Drawing Sheets

COMPACT BEVERAGE COOLING APPARATUS

CROSS REFERENCE TO RELATED APPLICATIONS

This application claims the benefit of U.S. Provisional Application 62/142,153 titled "Slim Cooler" filed Apr. 2, 2015. The entire disclosures of the above-referenced application are incorporated herein by reference in entirety for all purposes.

FIELD OF THE INVENTION

The present invention relates to a cooling apparatus for the storage and transport of beverage containers in a space efficient manner.

BACKGROUND OF THE INVENTION

People use a cooling apparatus to keep drinks or food items at temperatures lower than the surrounding environment. Using cooling apparatuses is commonly associated with recreational activities including picnicking, tailgating at sporting events, barbeques and going to the beach. Using cooling apparatuses allows a user to keep an item stored within at a cooler than ambient temperature for a longer period of time.

Existing coolers have numerous forms, varying shapes and sizes. The traditional cooler, typically has an insulated rectangular volumetric receptacle and a removable or hinged door for access to the items stored within.

The volumetric capacity provided by some coolers often exceeds a user's need. This is burdensome to the user, and a cooler with large amounts of unused volume is inefficient. Not only is transport inefficient, but the cooling efficiency suffers, resulting in a cooler which does not stay cool as long. The cooling inefficiency is due to unused volume, or air-volume, having a lower specific heat value than pre-cooled items which are typically placed within a cooler, including full beverage containers, food-items, ice-packs and the like. A cooler that has pre-cooled items occupying the entirety of the internal volume, has a larger thermal mass than that of a cooler with unutilized internal volume. As a result, a cooler filled with pre-cooled items will keep items in the cooler colder for a longer period of time than a cooler with unused internal volume.

To overcome the cooling inefficiencies surrounding unused internal volume within a cooler, a user may fill the unused internal volume with more precooled items such as food items, beverage containers and ice-packs. This increases the thermal mass in relation to the volume within the cooler, which increases the efficiency of the cooler and serves to keep items placed in the cooler colder for a longer period of time. However, the drawback is that the user must then transport a cooler, which is too large for the application and heavier than otherwise necessary.

Existing coolers, such as U.S. Pat. No. 9,211,902 to Vanderberg, et al., incorporated in entirety by reference, employ wheels with a cooler for the increased portability of a cooler. However, transporting these coolers remain cumbersome and difficult, particularly when transporting the cooler across uneven surfaces such as grass or sand.

Existing solutions attempt to provide storage and cooling of only beverage containers in order to provide a smaller form-factor cooler, typically for beverage containers holding a 355 mL (12 Fluid Ounces) volume. Examples of such solutions include U.S. Pat. No. 8,991,600 to Normand ("the '600 patent"), U.S. Pat. No. 5,095,718 to Ormond ("the '718 patent") and U.S. Pat. No. 3,263,806 ("the '806 patent"); each incorporated in their entirety by reference. Such solutions as the '600 patent, the '718 patent and the '806 patent provide more space efficient coolers with insulated structures for a user who wishes to only transport beverage containers. Where such solutions fail surrounds a scenario in which a user wishes to transport beverage containers in conjunction with a secondary transportation device such as a such as a backpack, handbag or basket. The above cited references do not typically fit within a secondary transportation device and require a user to carry a both a cooler and a secondary transportation device.

To prevent carrying a separate cooler in addition to a secondary transportation devices, some users are left to place pre-cooled beverage containers into a non-insulated transportation device that they are already carrying. It will be appreciated by those skilled in the art that in such scenarios, the beverage containers will warm up, reaching a thermal equilibrium with the surrounding environment at a much faster rate than a beverage container placed within a cooler with pre-cooled objects.

SUMMARY OF THE INVENTION

The present invention as disclosed herein surrounds a cooling apparatus configured to provide an enclosed envelope and optional ice-pack cooling for a minimal form-factor. Certain embodiments of the present invention provide a cooling apparatus for the transportation of beverage containers in a manner that keeps them colder for longer periods than transport within a non-insulated transportation device. The efficient and compact cooling of beverage containers as provided by the present invention allows the user to transport the cooling apparatus within a backpack, handbag or other secondary transportation device. This provides a user with the option to transport beverage containers within an apparatus that provides the benefits of a traditional cooler without the inconvenience of carrying additional objects.

Certain embodiments of the invention comprise an enclosure and a reusable cooling-pack. The internal volume of the enclosure is configured to hold a plurality of beverage containers in an array to minimize unused volume. The reusable cooling-pack is configured to nest between the beverage containers to occupy otherwise unused volume.

In certain embodiments, an enclosure is configured to hold a plurality of beverage containers of either a can or bottle type. In such embodiments, the reusable cooling-pack may be configured to fill the unused volume between a plurality of can-type beverage containers or a plurality of bottle-type beverage containers.

Certain embodiments of the invention are configured specifically for the transportation of standardized beverage containers including but not limited to a 355 ml (12 Fluid Ounces) aluminum can or glass bottle as commonly used in the United States. It will be appreciated by those skilled in the art that standard beverage containers may differ in dimension, volumetric capacity, form-factor and material and alternative embodiments of the current invention may be configured to fit beverage containers of any dimension, volumetric capacity, form-factor or material.

BRIEF DESCRIPTION OF FIGURES

FIG. 1B—A side transparent view of an embodiment of a cooling apparatus holding beverage containers.

FIG. 5B—A side transparent view of an embodiment of a cooling apparatus holding beverage containers.

FIG. 6B—A perspective view of an embodiment of the internal volume of an enclosure.

FIG. 10B—A side view of an embodiment of an enclosure.

FIG. 10C—A perspective exploded view of an embodiment of a clam-shell part.

FIG. 11B—A side view of a cooling apparatus opened in certain embodiments.

FIG. 11C—A side view of a cooling apparatus with a carrying provision in certain embodiments.

DETAILED DESCRIPTION OF CERTAIN EMBODIMENTS

The present disclosure surrounds an apparatus comprising a cooling apparatus for maintaining beverage container temperatures below ambient temperatures in a space-efficient form-factor.

Figure 1A:
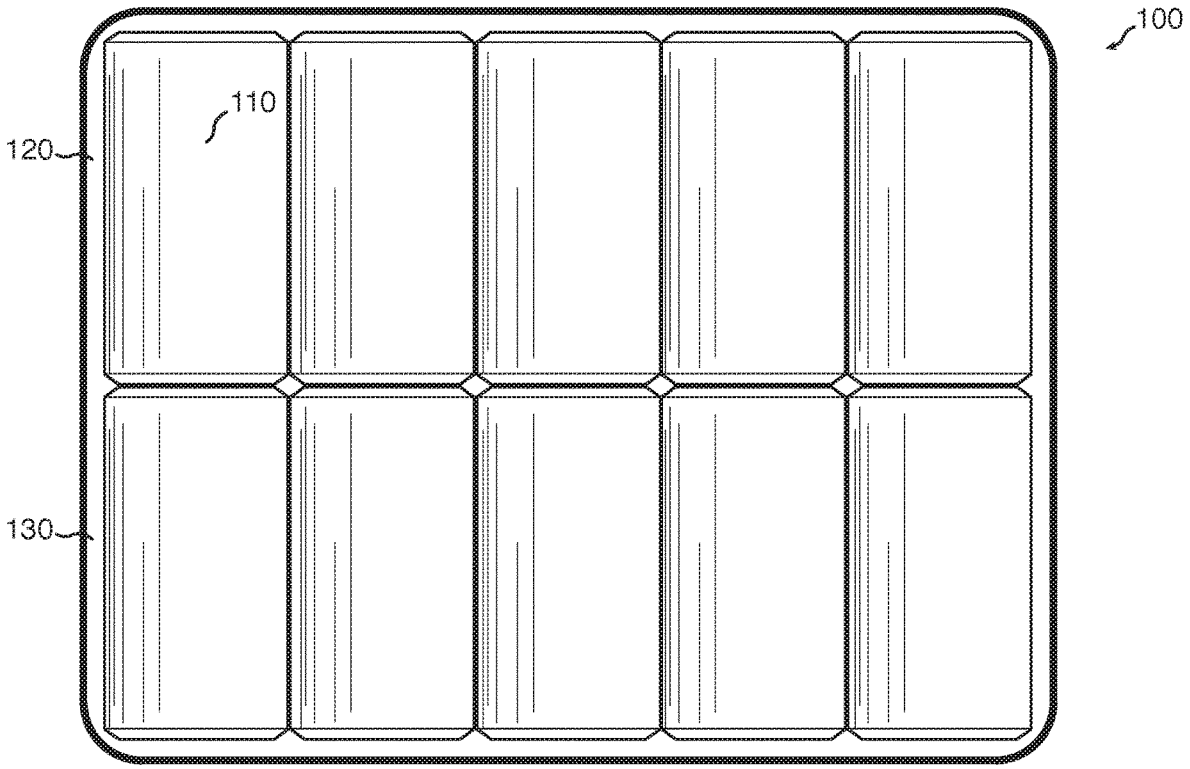
FIG. 1A—A top transparent view of an embodiment of a cooling apparatus holding beverage containers.
Figure 1B:
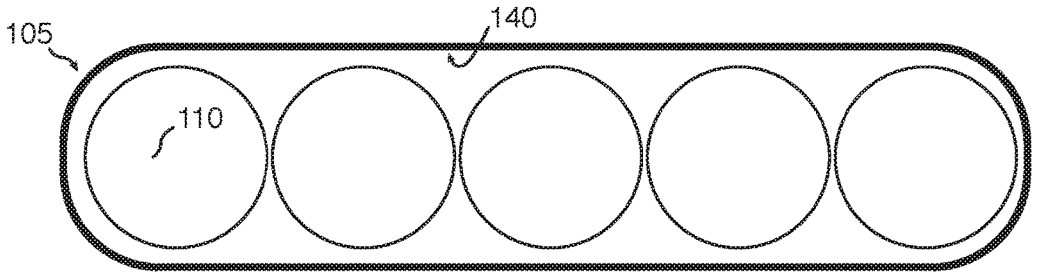

As shown in FIG. 1A and FIG. 1B, certain embodiments of a cooling apparatus 100 comprise an enclosure 105 configured to accept a plurality of beverage containers 110 configured in an array. Such an array is configured with a first distal end of a first beverage container and a first distal end of a second beverage container in contact with each other. The first beverage container is in a first row 120 of beverage containers 110 and the second beverage container is in a second row 130 of beverage containers 110. Each row of beverage containers 110 comprises a plurality of beverage containers 110 adjacent to each other. The external surface of each beverage container 110 is in lateral contact with a shared surface 140 of the cooling apparatus and the external surface of an adjacent beverage container 110.

Figure 2:
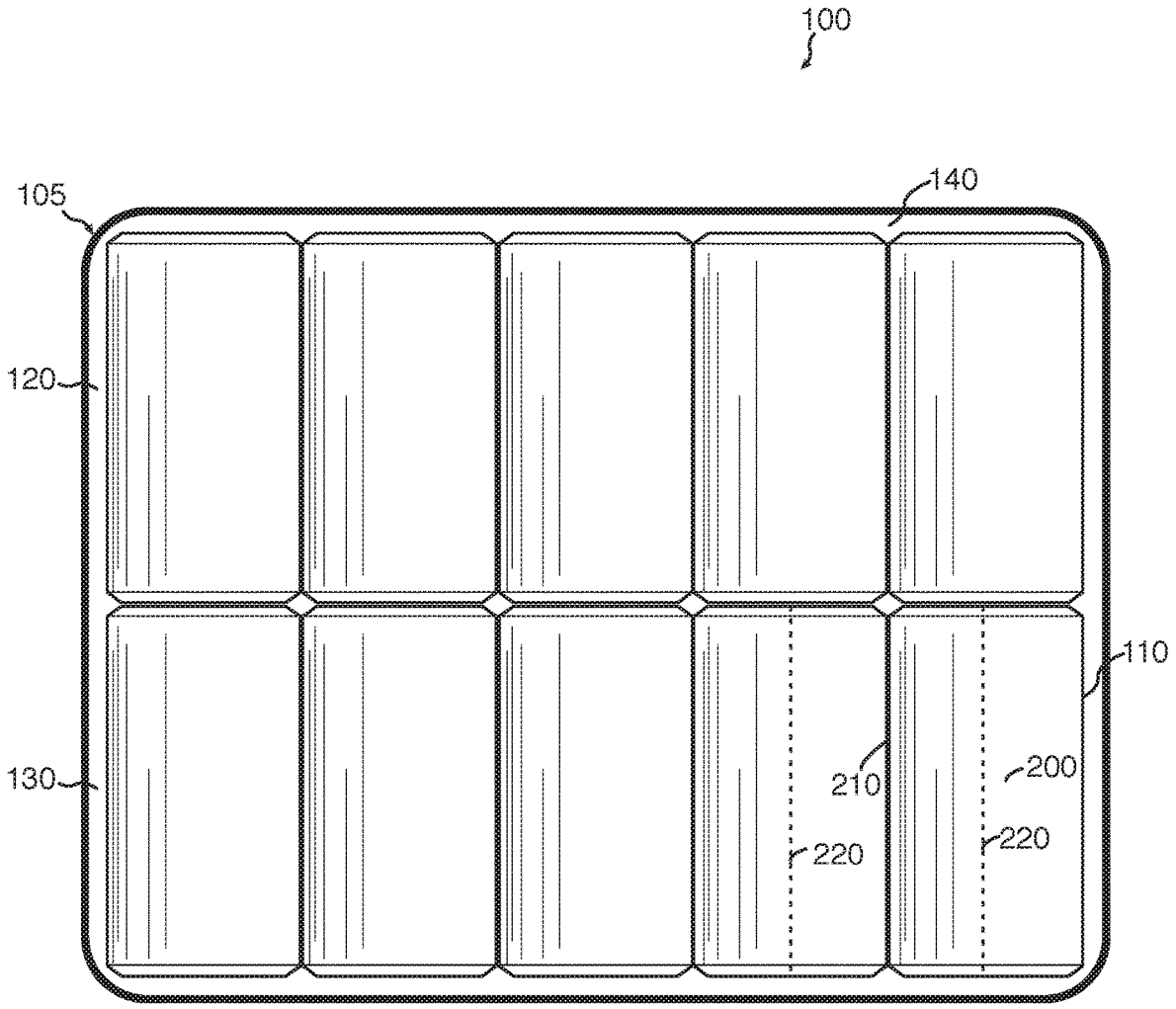
FIG. 2—A top transparent view of an embodiment of a cooling apparatus holding beverage containers.

Certain embodiments of a cooling apparatus 100, as shown in FIG. 2, comprise an enclosure 105 configured to accept a plurality of beverage containers 110 configured in a planar array. Such an array is configured with a first distal end of a first beverage container and a first distal end of a second beverage container in contact with each other. The first beverage container is in a first row 120 of beverage containers 110 and the second beverage container is in a second row 130 of beverage containers 110. Each row of beverage containers 110 comprises a plurality of beverage containers 110 adjacent to each other with the central axis 220 of each beverage container parallel with the beverage container adjacent to it. The external surface 200 of each beverage container 110 is in contact with a shared surface 140 of the cooling apparatus 100 and the external surface 200 of an adjacent beverage container 110. The contact between adjacent beverage containers 110 is such that the contact interface 210 between adjacent beverage containers 110 is parallel to the central axes 220 of the adjacent beverage containers.

Figure 3:
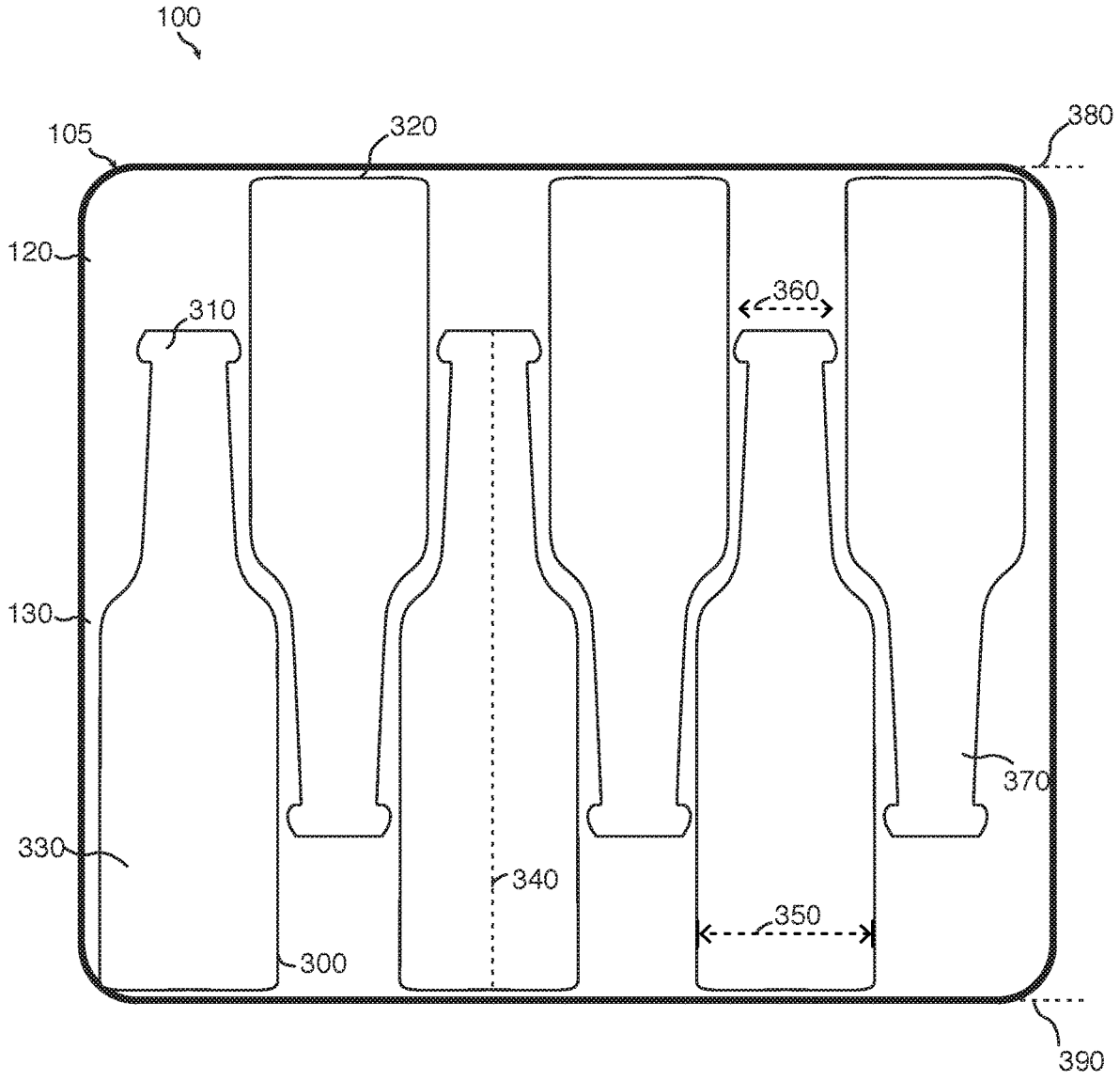
FIG. 3—A top transparent view of an embodiment of a cooling apparatus holding beverage bottles.

Certain embodiments of a cooling apparatus 100, as shown in FIG. 3, comprise an enclosure 105 configured to accept a plurality of beverage bottles 300, configured in an array. An array in such an embodiment is configured with a plurality of rows, each row comprising a plurality of bottles 300. It will be appreciated that a bottle comprises a bottle top 310, bottle bottom 320 and bottle body 330 centered upon a central axis 340 of each bottle 300. The bottle body 330 of typically tapers from a maximum diameter 350 to a smaller diameter 360 proximate to the bottle top 310. This tapered portion is typically referred to as the bottle neck 370. In such an embodiment, a first row 120 comprises a plurality of bottles 300 with the bottle bottoms 320 against a shared first plane 380. A second row 130 comprising a plurality of bottles 300 is arranged such that the bottle bottoms 330 of the second row 130 are in contact with a shared second plane 390. The shared second plane 390 is opposite and substantially parallel to the shared first plane 380. In this configuration, the bottle necks 370 and bottle tops 310 of the bottles 300 comprising the first row 120 are proximate to the bottle necks 370 and bottle tops 310 of the bottles 300 comprising the second row 130. As demonstrated in FIG. 3, it may be desired for the bottle necks 370 of the bottles 300 comprising the first row 120 to be interdigitated with the bottle necks 370 of the bottles 300 of the second row 130.

Figure 4:
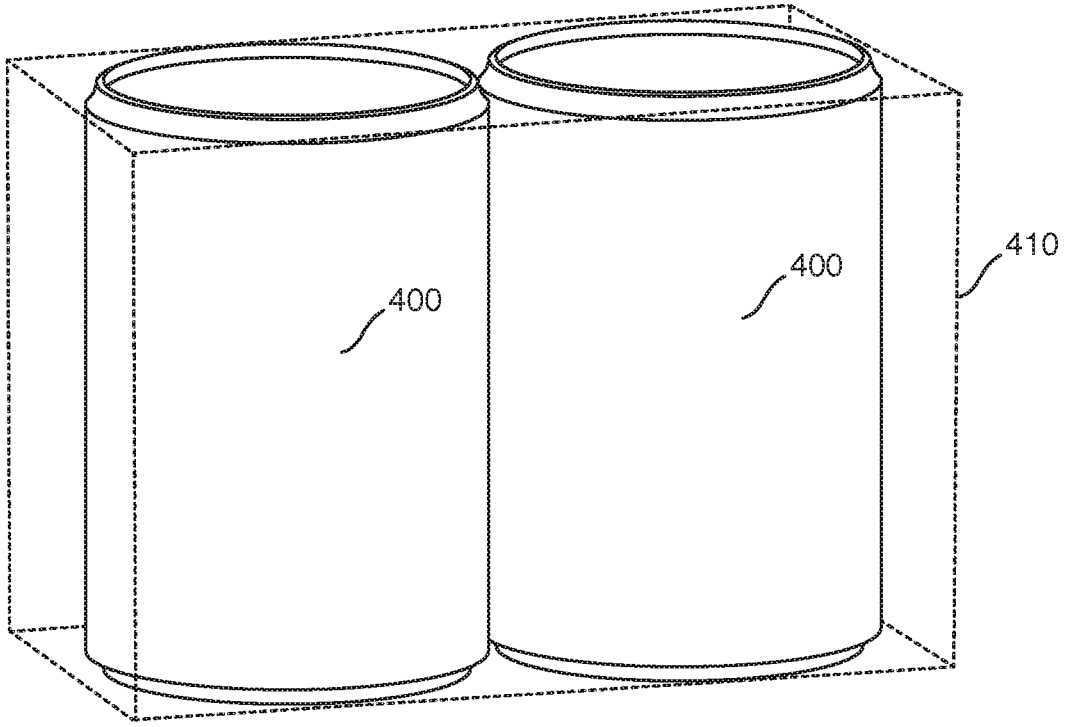
FIG. 4—A configuration of cylindrical devices demonstrating volumetric differences between cylindrical objects and a volumetric envelope.

It will be appreciated that the storage of beverage containers in an array configuration allows for space efficient storage and transportation of beverage containers. It will be further appreciated, as demonstrated in FIG. 4 that any array of cylindrical objects 400 will result in unused volume due to volumetric losses characteristic of the storage of such cylindrical objects 400. For instance, assuming identical cylindrical objects 400: A first end of the first cylindrical object 400 and a first end of the second cylindrical object 400 are coplanar. A second end of a first cylindrical object 400 and a second end of the second cylindrical object 400 are coplanar. The exterior surfaces of the first cylindrical object 400 and the second cylindrical object 400 are in direct contact with each other. In such a configuration, based on volumetric calculations of the actual volume of the cylindrical object 400 versus the rectangular prism defining the volumetric envelope 410 surrounding the cylindrical objects 400, there is approximately 21.5% unused volume.

Figure 5A:
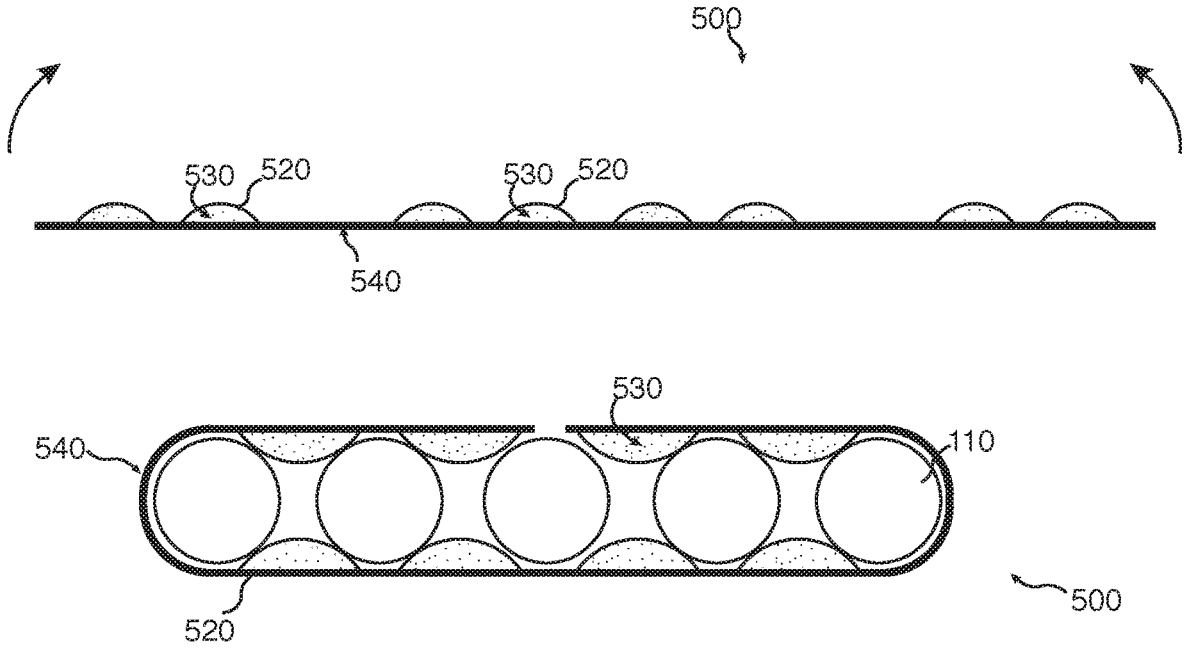
FIG. 5A—A side view of an embodiment of a cooling-pack in a flat and wrapped orientation.
Figure 5B:
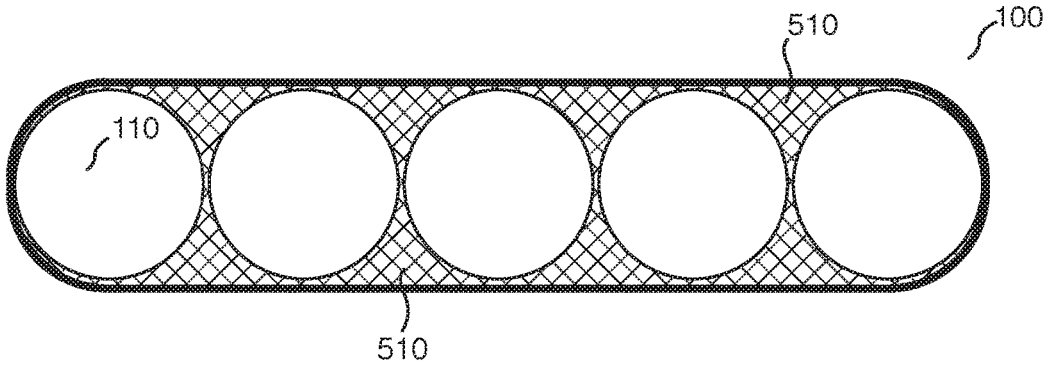

Certain embodiments of the cooling apparatus 100, as shown in FIGS. 5A and 5B provides a cooling-pack 500 configured to occupy the unused volume 510 between beverage containers 110, such as those with a cylindrical profile. A cooling-pack 500 as associated with such embodiments comprises a plurality of sealed compartments 520 filled with a cooling substance 530—typically a gel or fluid—intended for introducing to freezing temperatures for cooling of beverage containers 110. Each sealed compartment 520 is connected to an adjacent sealed compartment by a flexible structure 540. It will be appreciated that the flexible structure 540 may comprise materials such as plastic, textile, rubber or other materials providing flexible connection. Certain embodiments of the cooling-pack 500 are configured to occupy the unused volume 510 between a cooling apparatus 100 and the beverage containers 110 held within. Alternative embodiments of the cooling-pack 500 are configured to occupy the unused volume 510 between a cooling apparatus 100 configured for the cooling, storage and transport of beverage bottles 300 such as the configuration shown in FIG. 3.

Figure 6A:
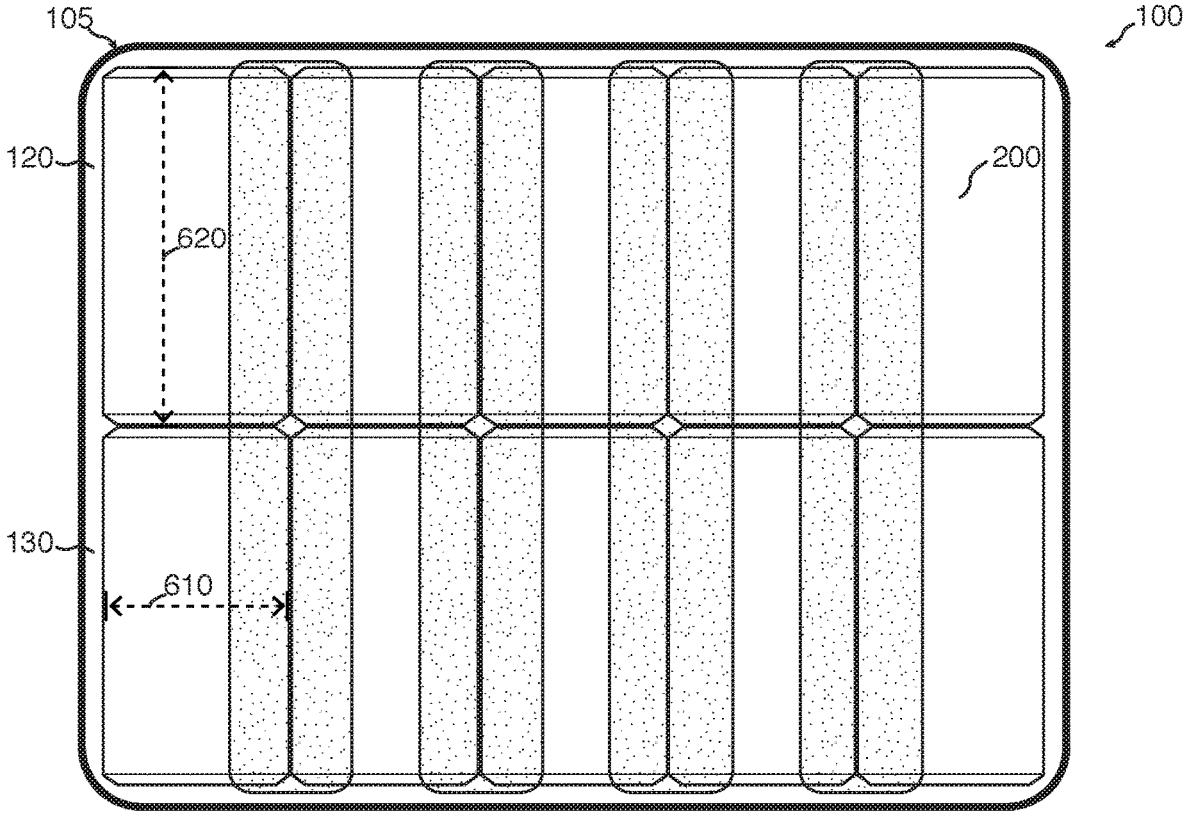
FIG. 6A—A top transparent view of an embodiment of a cooling apparatus holding beverage containers.
Figure 6B:
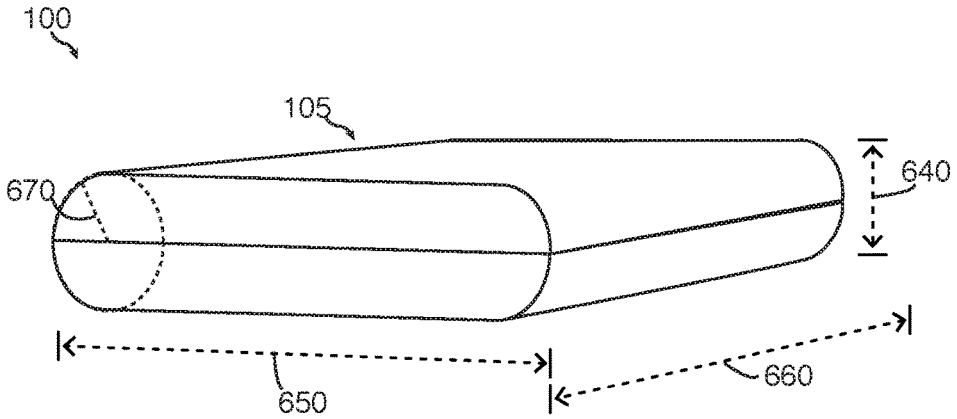

In certain embodiments, a cooling apparatus 100 is configured to provide storage and cooling for cans 600, having a cylindrical profile. As shown in FIG. 6A and FIG. 6B, certain embodiments are configured for the storage and cooling of ten cylindrical cans 600. In certain embodiments, the cans 600 referenced are of 355 mL (12 Fluid Ounces) capacity and have a maximum diameter 610 of 66 mm (2.6 inches) and height 620 of 123 mm (4.83 inches). In such embodiments, enclosure 105 comprising the internal volume of the cooling apparatus 100 is configured as a rectangular prism with two opposing sides spanning the enclosure width 650 having a radial profile. In such embodiments the enclosure height 640 is 66 mm (2.6 inches), enclosure width 650 is 267 mm (10.5 inches) and enclosure length 660 is 333 mm (13.1 inches). The two opposing sides that span the enclosure width 650 of the enclosure 105 have an enclosure radius 670 of 33 mm (1.3 inches). The cans 600 of such embodiments are configured in an array comprising two rows of cans such that a first end of each can in the first row 120 is in contact with the first end of a can in the second row 130 and the external surface 200 of each can is in lateral contact with the external surface of an adjacent can.

Certain embodiments of a cooling apparatus comprise a cooling-pack configured for the storage and cooling of a plurality of beverage cans. In certain embodiments, the cooling-pack is configured to store and cool ten beverage cans. The cooling pack of such embodiments comprises eight sealed compartments filled with a cooling substance in interface with each of the unused volumes between adjacent cans.

Figure 7:
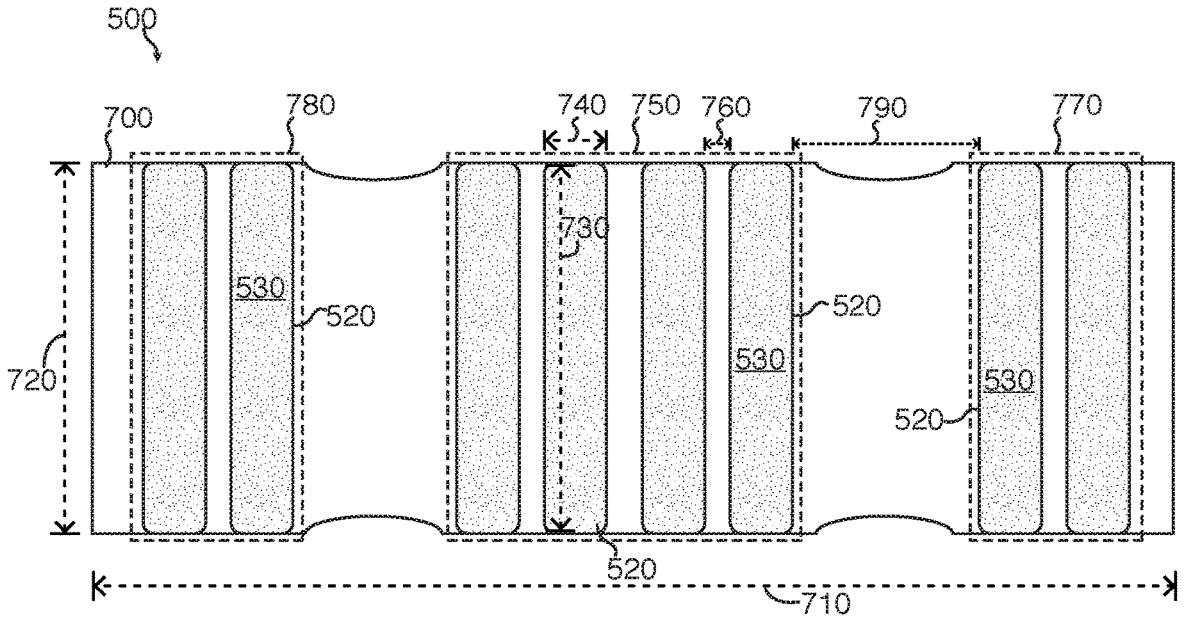
FIG. 7—A top view of an embodiment of a cooling-pack.

Certain embodiments of the cooling-pack 500, as shown in FIG. 7, comprise a plurality of plastic layers sealed together to construct a flexible membrane 700 with sealed compartments 520 disposed between the plastic layers. These sealed compartments 520, being filled with a cooling substance 530, are spaced to interface with unused volume 510 between cans as shown in FIG. 5B. Certain embodiments of the cooling-pack 500 comprise a flexible membrane 700 with membrane length 710 of 796 mm (31.3 inches) and membrane width 720 of 260 mm (10.2 inches) with eight sealed compartments 520 disposed within a flexible membrane 700 constructed with 0.1 mm (0.004 inches). Each of the sealed compartments 520 span the membrane width 720. Each sealed compartment 520 having a compartment length 730 of 260 mm (10.2 in), compartment width 740 of 34 mm (1.3 in) and filled with 75 mL (2.5 Fluid Ounces) of cooling substance 530. A grouping of sealed compartments 520 can comprise a plurality of sealed compartments 520, each offset laterally from adjacent sealed compartments 520 within the same grouping at a compartment offset 760 of 38 mm (1.5 inches). A first grouping 750 comprises four sealed compartments 520 and is centered along the membrane length 710 of the flexible membrane 700. A second grouping 770 and third grouping 780 comprising two sealed compartments 520 each are offset laterally, toward the distal ends of the flexible membrane 700 by grouping offset 790 of 142 mm (5.6 inches) from the distal edges of the first grouping 750 of sealed compartments 520. It will be appreciated that the grouping offset 790 is typically equal to or greater than half the maximum perimeter of a beverage container for which the cooling-pack is configured.

Certain embodiments as shown in FIG. 6A and FIG. 6B are configured for the use with the storage and cooling of 10 beverage containers in the form of cans 600. Certain embodiments of a cooling pack 500, as shown in FIG. 7, are configured for the use with a cooling beverage container in the form of a can. The first grouping 750 of sealed compartments 520 rest beneath beverage containers within a cooling apparatus. As shown in FIG. 5A, the sealed compartments 520, containing cooling substance 530, occupy the unused volume 510 between the beverage containers 110. The user may wrap the flexible membrane 700 around the distal cans 600 of the array of cans, into a wrapped configuration (configuration shown in FIG. 1A). With the cooling pack 500 configured as shown in FIG. 7, the cooling pack 500 may be used in a wrapped configuration by wrapping the flexible membrane 700 around distal canned beverage containers such that the second grouping 770 and third grouping 780 of sealed compartments 520 rest on top of the canned beverages. In doing so, as shown in FIGS. 5A and 5B, the sealed compartments 520 occupy the unused volumes 510 on the top and bottom between adjacent beverage containers 110.

Figure 8:
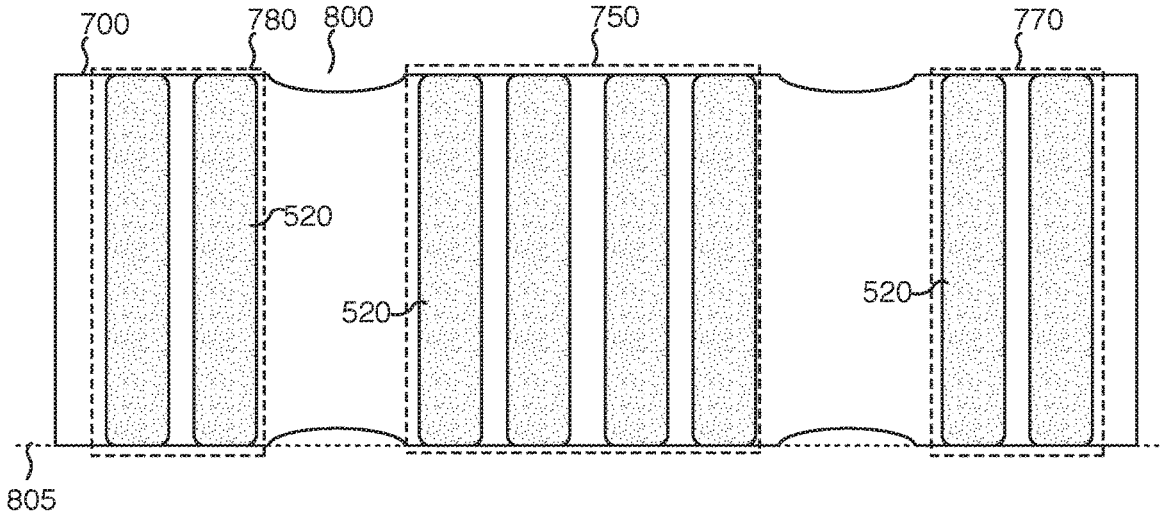
FIG. 8—A top view of an embodiment of a cooling-pack.

In certain embodiments of the cooling-pack, as shown in FIG. 8, it may be desired to have a clearance cut 800 in the longitudinal edge 805 of the flexible membrane 700 along the portions of the membrane spanning between the first grouping 750 second grouping 770 of sealed compartments 520 and along the portions of the flexible membrane 700 spanning between the first grouping 750 and third grouping 780 of sealed compartments 520. In certain embodiments a clearance cut 800 has a symmetric form with clearance cut length 810 of 130 mm (5.1 inches) with a maximum clearance cut depth 820 of 25 mm (1 inches). Such clearance cuts 800 in the longitudinal edges 805 of the flexible membrane 700 are intended to correspond with the areas in which the flexible membrane 700 wraps around the most distal cans as previously discussed. Such a clearance cut 800 is intended to prevent interference between the flexible membrane 700 and the enclosure.

It will be appreciated that embodiments of a cooling apparatus, or component parts thereof, intended for use with beverage cans may be used in conjunction with the storage and cooling of beverage bottles of similar diameter.

It will be appreciated that the dimensions of the flexible membrane, sealed compartments and volumetric capacity of the sealed compartments can me modified to accommodate different configurations and dimensions of the enclosure, beverage container type, beverage container dimensions and quantity of beverage containers held within an enclosure associated with embodiments of the cooling apparatus.

Figure 9:
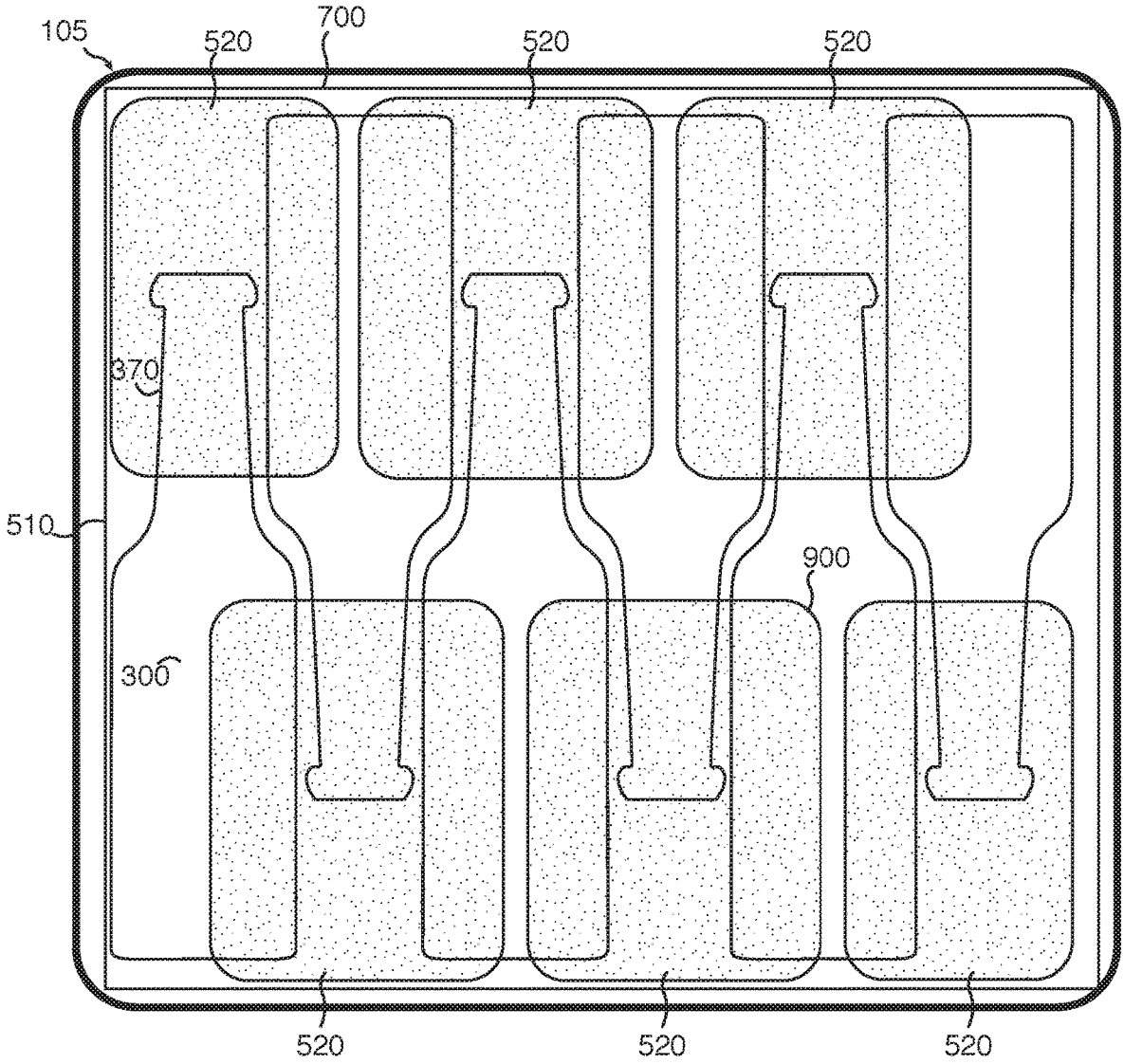
FIG. 9—A top transparent view of an embodiment of a cooling apparatus holding beverage bottles.

Certain embodiments of a cooling apparatus, as shown in FIG. 9, comprise a cooling-pack 700 intended for use specifically with the storage and cooling of bottles 300. Such embodiments comprise sealed compartments 520 to occupy the unused volume 510 between adjacent bottles 300 and the interdigitated bottle necks 370.

Figure 10A:
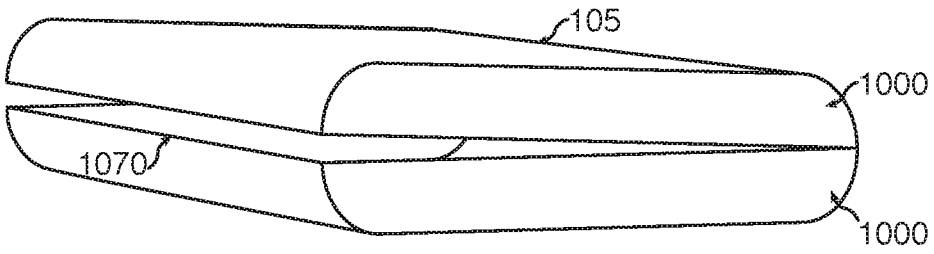
FIG. 10A—A perspective view of an embodiment of an enclosure.
Figure 10B:
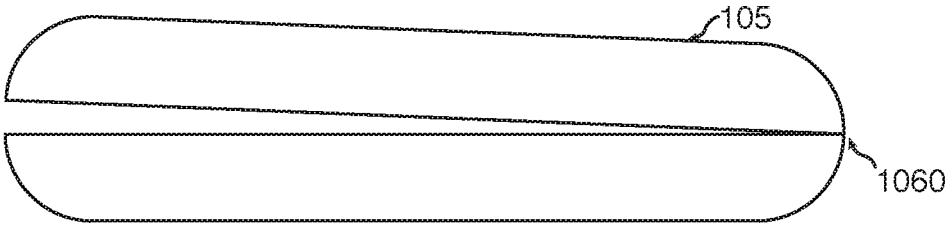
Figure 10C:
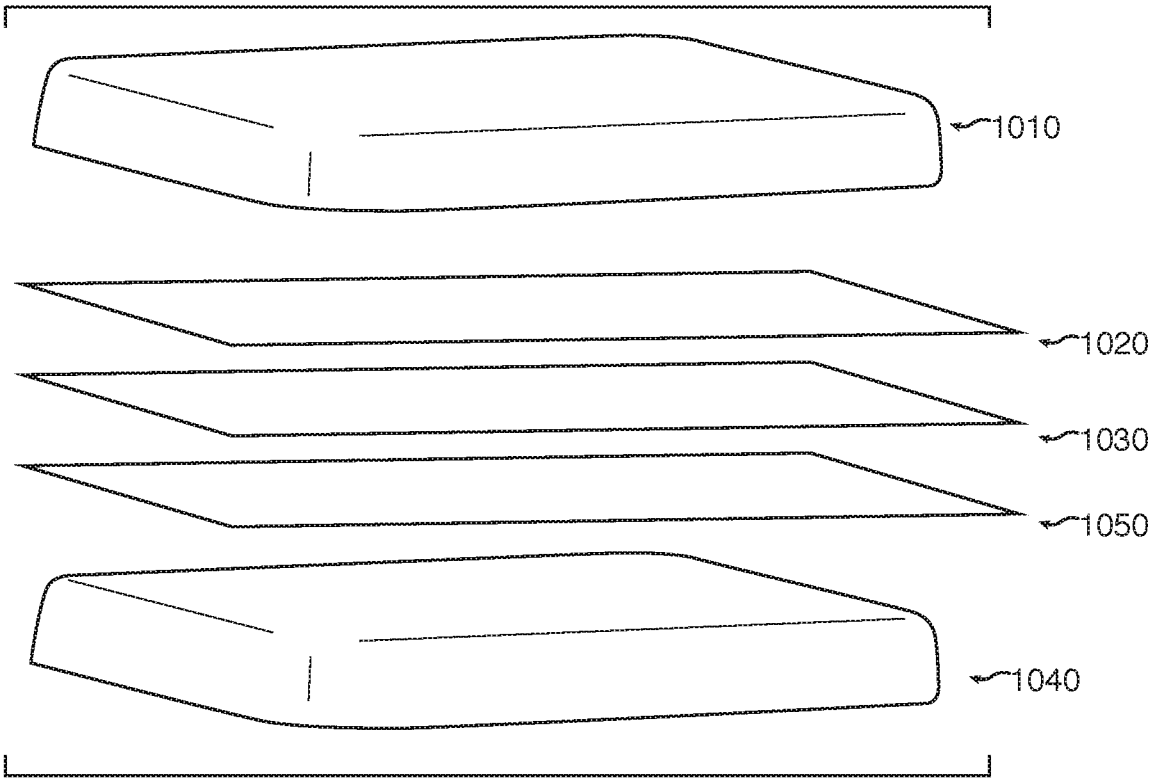

Certain embodiments of the enclosure, referencing FIG. 10A, FIG. 10B and FIG. 10C, comprising a cooling apparatus, comprise a first clam-shell part 1000 and a second clam-shell-part 1000 creating an internal volume. Certain embodiments of a clam-shell part 1000 comprise an outer shell 1010 and an internal shell 1040 with a volume disposed between them. It may be desired to insert insulative layers between the outer shell 1010 and the internal shell 1040. In certain embodiments a clam-shell part 1000 comprises an outer shell 1010, a first thermal reflective layer 1020, a thermal insulation layer 1030 and an internal shell 1040. It will be appreciated that the layers of such an enclosure 105 may be adjusted in material, quantity or order to achieve a desired level of structure, waterproofing, or insulation.

It will be appreciated by those skilled in the art that a clam-shell part 1000, as shown in FIG. 10A may comprise what is commonly referred to in the art as vacuum insulation. Certain embodiments of a clam-shell part 1000 comprise an outer shell and an internal shell with a pressure sealed volume disposed between the outer shell and the internal shell. This pressure sealed volume has a pressure less than ambient pressure. It will be further appreciated by those skilled in the art, that the insulative properties of such a volume increase as the pressure decreases and approaches a true vacuum.

Again referencing FIG. 10A, FIG. 10B and FIG. 10C, certain embodiments of the enclosure comprise two identical clam-shell parts 1000 hingedly attached by a hinge 1060 comprising rubber, plastic, textile or other flexible materials affixed along a portion of the clam-shell part 1000 perimeters. It will be appreciated to those skilled in the art that a hinge may comprise individual components of non-flexible nature interacting to act in a flexible nature as a whole. Examples of such hinges may include individual components constructed of plastic or metal materials. The clam-shell parts 1000 of certain embodiments are of substantially rectangular shape and are hingedly attached by a flexible hinge 1060 along a portion of a mating edge 1070. It will be appreciated that a mating edge 1070 is an edge of a first clam-shell part 1000 that interfaces with an edge of a second clam-shell part 1000 to enclose a volume between the first and second clam-shell parts 1000. The portions of the mating edges 1070 are affixable by way of an edge-locking device. It will be appreciated that an edge-locking device may comprise a zipper feature, elastic device, cinch strap or other constraining device intended to constrain two mating edges 1070 of two objects.

Again referencing FIG. 10A, FIG. 10B and FIG. 10C, certain embodiments of an enclosure 105 comprise two identical rectangular clam-shell parts 1000 that are hingedly attached along a mating edge 1070 of each clam-shell part 1000 to create an internal volume. Each clam-shell part 1000 comprises the following layers in order of exterior to interior: An outer shell 1010, a first layer of thermal reflective material 1020, a thermal insulation layer 1030, a second thermal reflective layer 1050 and an internal shell 1040. The outer shell 1010 comprises a rigid or semi-rigid foam such as a urethane or acrylic based foam. The first thermal reflective layer 1020 and second thermal reflective layer 1050 comprise materials such as biaxially-oriented polyethylene terephthalate (BoPET) commonly associated with trade names such as Mylar®, Melinex® and Hostaphan®. The thermal insulation layer 1030 comprises an insulative foam material and may further comprise a closed-cell or open-cell structure as associated with a polyurethane or acrylic based foam or other insulative materials. The internal shell 1040, comprises a molded polymer such as polyethylene, polystyrene or acrylic based plastic. The internal shell 1040 prevents moisture associated with condensate and spilled beverage from associated containers from contacting the internal insulative materials such as the thermal insulation layer 1030 as it will be appreciated those skilled in the art that the insulative performance of an insulative material may degrade when exposed to moisture.

Figure 11A:
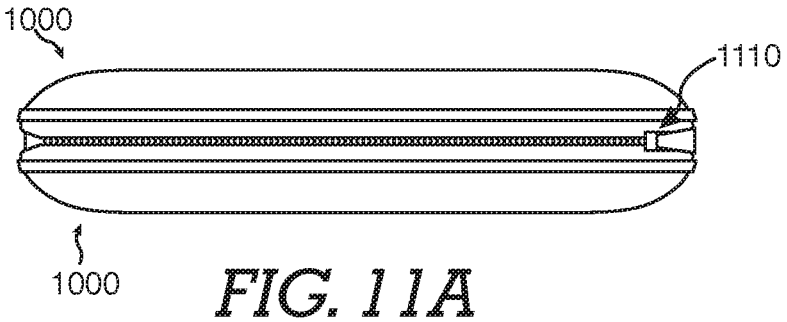
FIG. 11A—A side view of a cooling apparatus in certain embodiments.
Figure 11B:
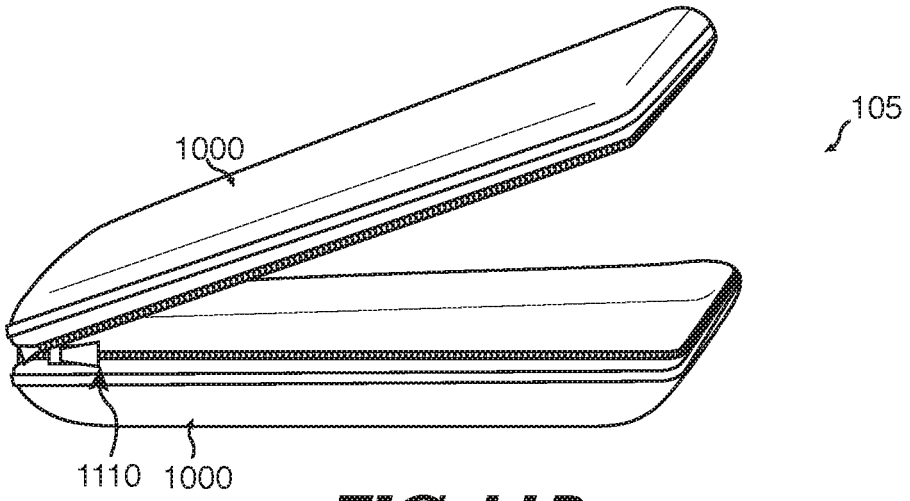
Figure 11C:
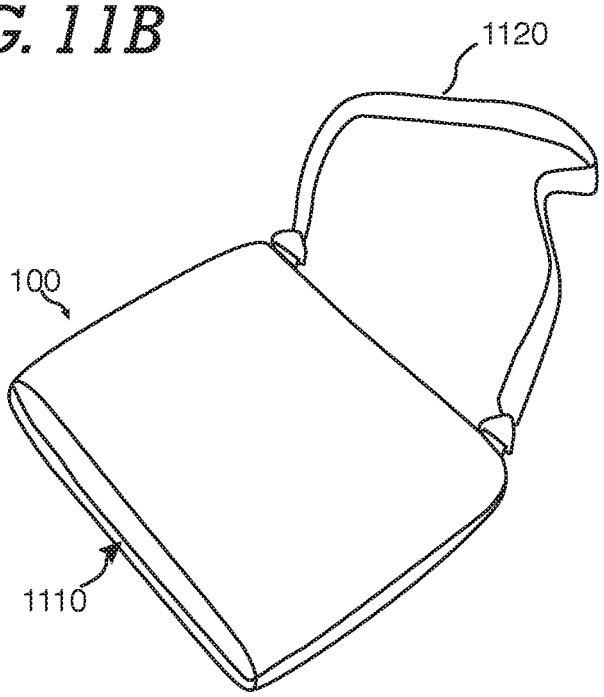

Referencing FIGS. 11A, 11B, and 11C, certain embodiments of an edge locking device comprise a zipper 1110 for affixing a first and second clam-shell part 1000 to create an enclosure 105. In certain embodiments, it may be desired to provide a carrying provision 1120 for when a user wishes to transport the cooling apparatus 100 without the need for a secondary transportation device. Such a carrying provision 1120 may comprise a carrying handle, shoulder strap or other carrying provision 1120 appreciated by those skilled in the art.

Figure 12:
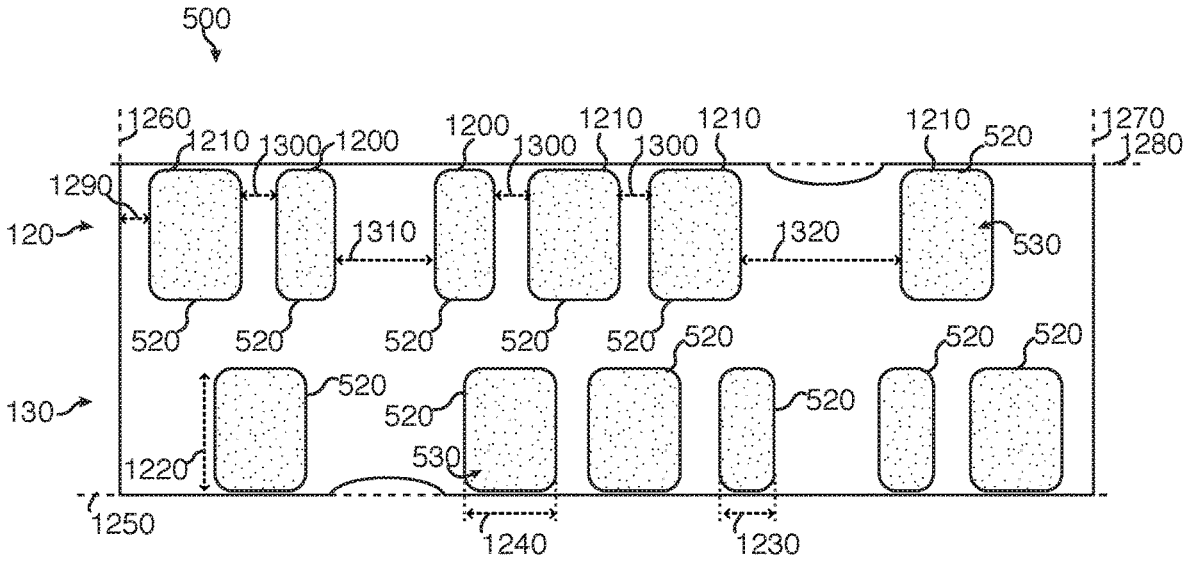
FIG. 12—A top view of a cooling pack in certain embodiments.
Figure 13:
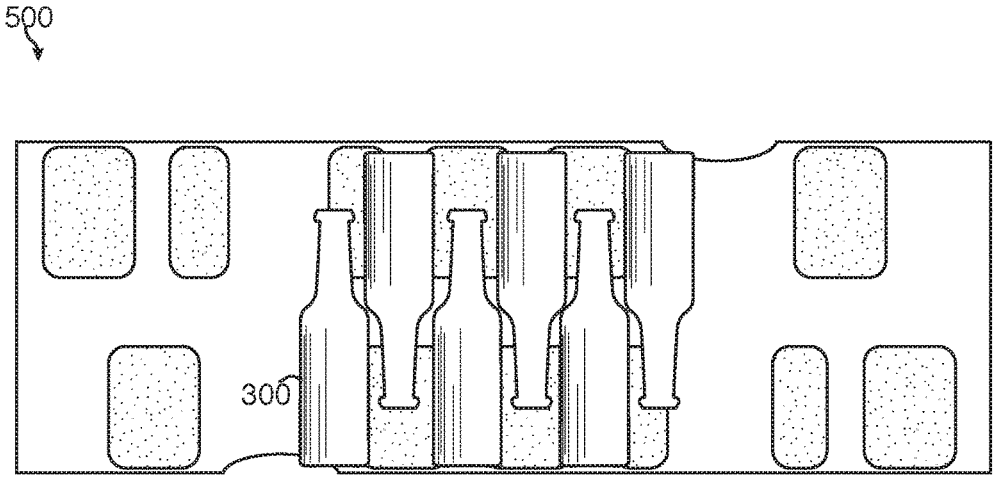
FIG. 13—A top view of a cooling pack with beverage bottles in certain embodiments.

Certain embodiments of a cooling-pack 500 are configured for use with the cooling of a plurality of beverage bottles 300 as shown in FIG. 12 and FIG. 13. Certain embodiments of the cooling-pack 500 are configured for the cooling of six bottles 300. In such embodiments as shown in FIG. 12, the bottles 300 are placed in a nested configuration such that the bottle necks 370 and bottle bodies 330 of the bottles 300 of a first row 120 are interdigitated with the bottle necks 370 and bottle bodies 330 of the bottles 300 of a second row 130. The cooling-pack 500 of such embodiments further comprises sealed compartments 520 containing a cooling substance 530 to occupy the unused volume 510 between the interdigitated bottle necks 370 and bottle bodies 330. The sealed compartments 520 are configured in coordination with the first row 120 and the second row 130 of bottles 300. Certain embodiments of the cooling-pack 500 comprise a narrow sealed compartment 1200 and a wide sealed compartment 1210, each having a bottle sealed compartment height 1220 of 114 mm (4.49 inches). The narrow sealed compartment has width 1230 of 32 mm (1.26 inches) and holds 25 mL (0.85 Fluid Ounces) of cooling substance 530. The wide sealed compartment has a width 1240 of 64 mm (2.52 inches) and holds 50 mL (1.69 Fluid Ounces) of cooling substance 530. The sealed compartments 520 configured to be coincident with the first row 120 are aligned parallel and proximal to a first longitudinal edge 1250. The configuration of the sealed compartments 520 coincident with the first row 120 comprises: an edge offset 1290 of distance 1290 of 25 mm (0.98 inches) from a first distal edge 1260, followed by a wide sealed compartment 1210, followed by an small offset 1300 of distance 38 mm (1.26 inches), followed by a narrow sealed compartment 1200, followed by a intermediate offset 1310 of distance 110 mm (4.33 inches), followed by a narrow sealed compartment 1200, followed by an small offset 1300, followed by a wide sealed compartment 1210, followed by a wide sealed compartment 1210, followed by a large offset 1320 of distance 142 mm (5.59 inches) followed by a wide sealed compartment 1210. It may be desired to have a clearance cut in the first longitudinal edge 1250 centered along the length of the large offset distance 1320. The sealed compartments 520 configured to be coincident with the second row 130 are aligned parallel and proximal to a second longitudinal edge 1280. In certain embodiments the configuration of the sealed compartments 520 coincident with the second row begin with an edge offset from a second distal edge 1270 and is identical to that of the sealed compartments 520 configured to be coincident with the first row 120. As shown in FIG. 13, certain embodiments of the cooling pack 500, are configured for the cooling of beverage bottles 300.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "first," "second," "proximal," "distal," etc., as used herein, are intended for illustrative purposes only and do not limit the embodiments in any way. Additionally, the term "plurality," as used herein, indicates any number greater than one, either disjunctively or conjunctively, as necessary, up to an infinite number. The benefits, advantages, solutions to problems, and any element(s) that may cause any benefit, advantage, or solution to occur or become more pronounced are not to be construed as a critical, required, or essential features or elements of any or all the claims.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the invention(s) described herein are capable of other embodiments and of being practiced or of being carried out in various ways. Various embodiments of the present invention(s) have been described in detail, it is apparent that modifications and alterations of those embodiments will occur to those skilled in the art. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed:

1. A cooling apparatus for the storage and cooling of objects comprising:

an enclosure comprising a first clam-shell part, a second clam-shell part, and a cooling-pack;

said first clam-shell part and second clam-shell part configured to interface along mating edges to define an internal volume;

said internal volume having an enclosure length, an enclosure width, and an enclosure height;

said cooling-pack having a plurality of sealed compartments configured to occupy unused volume between a plurality of beverage containers, and the plurality of sealed compartments comprising a separate volume of a cooling substance;

each of the plurality of the beverage containers have a maximum diameter and a height; and the plurality of sealed compartments comprising a first sealed compartment and a second sealed compartment, the first sealed compartment being offset from the second sealed compartment, and said first sealed compartment and said second sealed compartment being connected by a flexible membrane, wherein said enclosure width is equal to at least twice the maximum diameter of the plurality of beverage containers, and the enclosure length is equal to at least the height of the plurality of beverage containers.

2. The cooling apparatus of claim 1 further comprising a hinged attachment between a portion of a mating edge of said first clam-shell part and a portion of a first mating edge of said second clam-shell part.

3. The cooling apparatus of claim 1 further comprising an edge-locking device, which comprises a zipper, to constrain a mating edge of said first clam-shell part to a first mating edge of said second clam-shell part.

4. The cooling apparatus of claim 1, wherein said cooling-pack further comprises a first grouping of sealed compartments separated from a second grouping of sealed compartments by a grouping offset which is equal to or greater than half a maximum perimeter of said plurality of beverage containers, wherein the maximum perimeter of said beverage container is calculated by:

$$[\text{maximum perimeter}=\pi\times\text{maximum diameter}].$$

5. The cooling apparatus of claim 1 wherein said beverage container is a can with a cylindrical form.

6. The cooling apparatus of claim 1 wherein said beverage container is a bottle with a cylindrical form.

7. The cooling apparatus of claim 1 wherein said internal volume further comprises a first enclosure radius and a second enclosure radius at opposing ends of said enclosure width, said first enclosure radius and second enclosure radius extending parallel to the enclosure length of said internal volume.

8. The cooling apparatus of claim 7 wherein the first enclosure radius and the second enclosure radius is half of said maximum diameter of said beverage containers.

9. The cooling apparatus of claim 1 wherein said enclosure is configured to accept a plurality of rows of beverage containers wherein:

a first end of a first beverage container in a first row is in contact with a first end of a first beverage container in a second row;

an external circumferential surface of said first beverage container in said first row is contact with an external circumferential surface of a second beverage container in said first row; and an external circumferential surface of said first beverage container in said second row is in contact with an external circumferential surface of a second beverage container in said second row.

10. The cooling apparatus of claim 1 wherein said first clam-shell part and said second clam-shell part have the same dimensions.

11. The cooling apparatus of claim 1 wherein said first clam-shell part and said second clam-shell part comprise a plurality of layers;

said plurality of layers having an outer shell, followed by a first thermal reflective layer, followed by an insulative layer, followed by a second thermal reflective layer, followed by an internal shell layer.

12. The cooling apparatus of claim 1 wherein said first clam-shell part and second clam-shell part comprise an outer shell and an internal shell with a pressure sealed volume between said outer-shell and said internal shell; and said pressure sealed volume having a pressure less than ambient pressure.

13. The cooling apparatus of claim 4, wherein the grouping offset is equal to or greater than 142 mm (5.6 inches).

14. The cooling apparatus of claim 4, wherein the sealed compartments within the first grouping of sealed compartments are offset from adjacent sealed compartments by a compartment offset.

15. The cooling apparatus of claim 14, wherein the compartment offset is equal to or greater than 38 mm (1.5 inches).

16. The cooling apparatus of claim 4, wherein said internal volume further comprises a first enclosure radius and a second enclosure radius at opposing ends of said enclosure width, said first enclosure radius and second enclosure radius extending parallel to the internal length of said internal volume.

17. The cooling apparatus of claim 16, wherein the enclosure radii are at least 33 mm (1.3 in.).

18. The cooling apparatus of claim 7, wherein the enclosure radii are at least 33 mm (1.3 in.).

19. The cooling apparatus of claim 7, wherein said cooling-pack further comprises a first grouping of sealed compartments separated from a second grouping of sealed compartments by a grouping offset which is equal to or greater than half a maximum perimeter of said plurality of beverage containers, wherein the maximum perimeter of said beverage container is calculated by:

$$[\text{maximum perimeter} = \pi \times \text{maximum diameter}].$$

* * * * *